United States Patent [19]

Hanlon et al.

[11] 4,366,197

[45] Dec. 28, 1982

[54] BUILDING WALL PANELS AND METHOD OF MAKING THE SAME

[75] Inventors: Charles M. Hanlon, Addison; James H. Mein, Palatine; William J. Schultz, Saint Charles, all of Ill.

[73] Assignee: Masonite Corporation, Chicago, Ill.

[21] Appl. No.: 172,558

[22] Filed: Jul. 28, 1980

[51] Int. Cl.[3] ..... E04D 1/26; E04D 3/30

[52] U.S. Cl. ..... 428/43; 52/526; 52/527; 52/555; 52/558; 264/284; 428/50; 428/151; 428/156; 144/347; 144/345

[58] Field of Search ..... 52/526, 527, 531, 555, 52/558; 428/156, 151, 50, 15, 43, 44, 326; 264/284; 144/309 A, 309 P, 328

[56] References Cited

U.S. PATENT DOCUMENTS

| | | | |
|---|---|---|---|
| 3,796,586 | 3/1974 | Hanlon et al. | 428/151 |
| 3,868,300 | 2/1975 | Wheeler | 156/210 |
| 4,279,106 | 7/1981 | Gleason et al. | 52/558 |

*Primary Examiner*—Paul J. Thibodeau

*Attorney, Agent, or Firm*—Mason, Kolehmainen, Rathburn & Wyss

[57] ABSTRACT

An exterior, deep embossed, shingle lap siding system for building well and roof structures comprising rectangular building panels having a decorative outer weather resistant surface embossed to resemble, when assembled, a plurality of rows of shingle elements laid side-by-side, said weather resistant outer surface including a lower edge portion projecting downwardly below the upper edge portion of the next subjacent row and having an irregular lower edge embossed to resemble the lower edges of a row of variable length shingles placed side-by-side. A method for making said rectangular building panels includes the steps of deep embossing a plurality of rows of said shingle elements on an integral sheet of pressed wood fibers or other suitable building material, the forming of a discontinuity of irregular appearance between adjacent rows and reducing the thickness of the lower edge of each row to separate the adjacent rows while providing an area of reduced thickness for overlapping adjacent rows of said building panels.

5 Claims, 5 Drawing Figures

BUILDING WALL PANELS AND METHOD OF MAKING THE SAME

BACKGROUND OF THE INVENTION

1. Field of the Invention

The present invention relates to building wall panels and more particularly to building wall panels for use in structural siding and roofing applications.

It is an object of the present invention to provide a new and improved building wall panel and more particularly a building wall panel suitable for use as a one-piece structural siding or roofing member with a weather resistant outer surface.

Another object of the present invention is to provide an integral siding/roofing building wall panel of the character described which provides both structural integrity and exterior weather facing for direct application to a flat building wall substructure or to studs or rafters.

It is another object of the present invention to provide a new and improved building wall panel of the character described having suitable structural characteristics and a one-piece embossed under weather surface resembling shingles laid in place.

Another object of the invention is to provide a new and improved building wall panel of the character described wherein the outer surface of the panel is formed in relief to resemble wood shingles, slate roofing, tile roofing or the like.

Another object of the present invention is to provide a new and improved building wall panel of the character described which is light in weight, strong, weatherproof, easy to handle and rapidly installable on the exterior wall or framework of a building.

Another object of the present invention is to provide a method of manufacture for economically providing the rectangular building panels of the character described.

2. Brief Description of the Prior Art

Typical of prior art is U.S. Pat. No. 3,796,586 directed toward a deep embossed shingle lap siding system in which a coloring or tinting agent is applied to selected portions to provide an appearance of stained wood shingles.

Another patent of interest is U.S. Pat. No. 4,015,392 directed to a building wall panel system in which the outer weather resistant surface is secured to a base sheet of structural material in which the structural base sheets interlock with one another so as to provide a weather-tight seal.

SUMMARY OF THE INVENTION

The foregoing and other objects and advantages of the present invention are accomplished in a new and improved deep embossed, integral siding/roofing building shingle lap siding system and method for making the same wherein a plurality of rectangular building panels having a decorative outer weather resistant surface embossed to resemble, when assembled, a plurality of rows of shingle elements laid side-by-side, said weather resistant outer surface including a lower edge portion projecting downwardly below the upper edge portion of the next subjacent row and having an irregular lower edge embossed to resemble the lower edges of a row of shingles placed side-by-side. A method for making said rectangular building panels includes the steps of deep embossing a plurality of rows of said shingle elements on an integral sheet of pressed wood fibers and the forming of a discontinuity of irregular appearance between adjacent rows and reducing the thickness of the lower edge of each row to separate the adjacent rows while providing an area of reduced thickness for overlapping adjacent rows of said building panels. The sheet material may comprise embossed hardwood, plywood, plastic or embossed molded polyurethane foam and the like formed by calendaring the surface to provide a weather-proof exterior surface. The building panels of the invention may be up to 16 feet in length and of varying dimensions transverse thereto depending upon whether the panel is designed to resemble shakes, wood shingles, roofing slate, Spanish tile, or the like. The building panels may also be formed in shorter lengths but preferably in multiples of the standard sixteen inch on center used in building frame construction. A unique method is disclosed for manufacturing a plurality of adjacent rows to resemble side-by-side shingles resulting in a structurally strong and weather tight joint between the adjacent rows of panels in a manner suitable for use on both vertical walls or sloping roofs.

BRIEF DESCRIPTION OF THE DRAWINGS

For a better understanding of the present invention, reference should be had to the following detailed description taken in conjunction with the drawings in which.

DESCRIPTION OF THE PREFERRED EMBODIMENT

Figure 1:
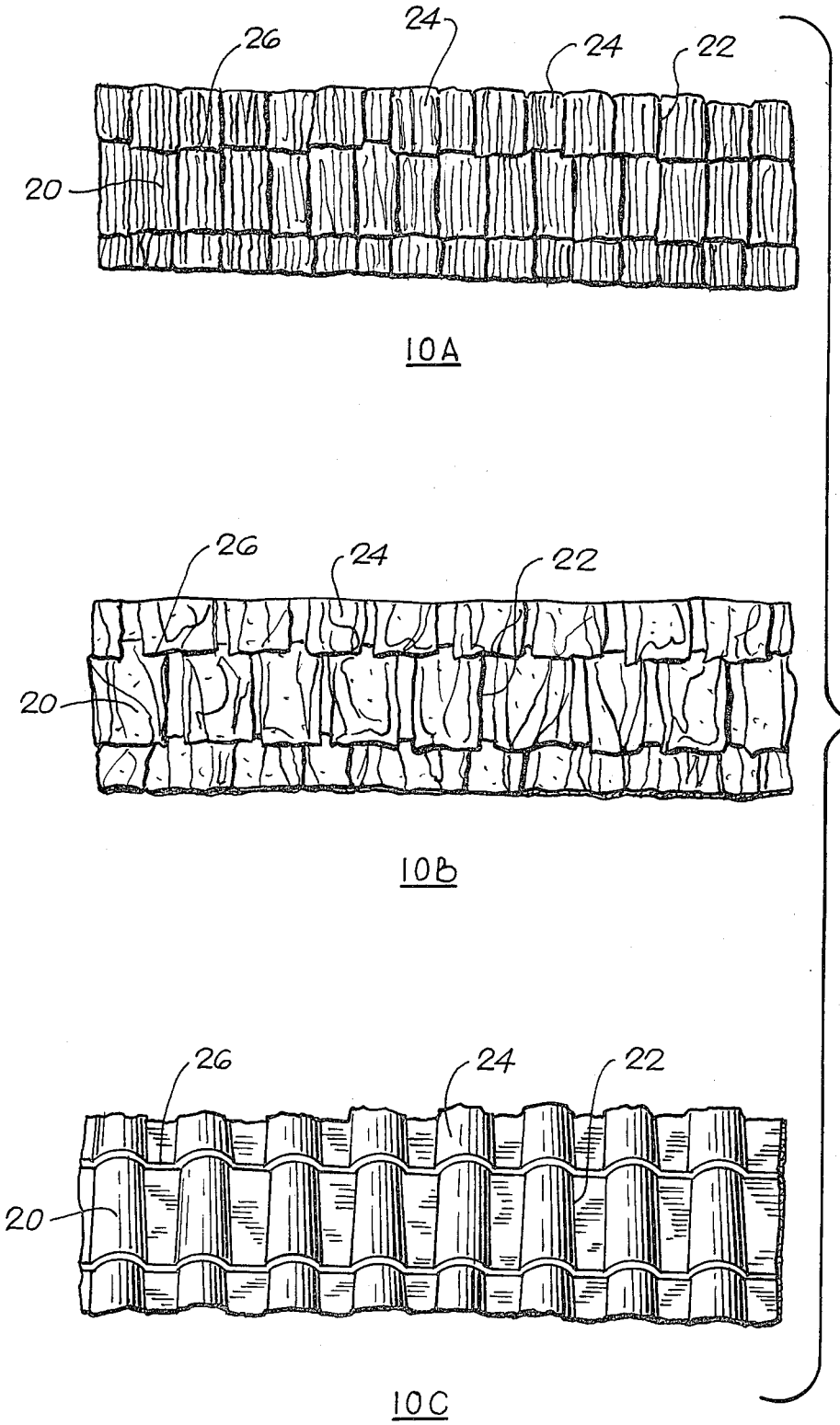
FIG. 1 is an outside view of a portion of a building wall surface showing a plurality of building wall panels constructed in accordance with the features of the present invention and designed to resemble wood shakes, slate roofing tiles and curved roofing tiles.

Referring now to FIG. 1, there is illustrated a plurality of building wall panels 10A, 10B and 10C constructed in accordance with the present invention and designed to resemble a building wall or roof surface having wood shingles or shakes, natural slate roofing tiles and Spanish tile roofing tiles, respectively. Unlike previous building wall panels of this type, the building wall panels 10A, 10B and 10C do not require a base supporting structure. The building wall panels shown in FIG. 1 are preferably manufactured in predetermined lengths for mounting on conventional structural support members wherein the studs or rafters are on sixteen inch center. Each of the rectangular building panels 10A, 10B or 10C include an integral weather resistant outer face or surface 20. The outer weather resistant surface is formed in a conventional manner by deep embossing the outer surface 20 of a suitable building material to provide a relatively nonporous surface including three-dimensional characteristics providing outline or peripheral surfaces 22 representing each shingle slate or tile periphery and a plurality of additional relief lines 24 representing the respective grain lines or colorations of the various shake or tile elements. In addition, the rectangular building panels 10 of the present invention include an irregular lower edge 26 for example in the shake construction 10A providing a realistic yet integral building material. The building panels are applied to the exterior surface or framework of a building in an overlapping or shingle-type lap siding manner to provide a weatherproof water-tight seal along the irregular edge 26.

In accordance with the present invention a variety of different building materials may be utilized in producing the novel building wall panels 20. Referring to FIG. 1, panels 10A having an outer weather resistant surface resembling wood shakes and panels 10B having an outer weather resistant surface resembling slate shingles may be formed in the outer layers of multi-layer exterior plywood having a suitable number of layers for the desired strength and having an outer weather resistant surface formed in an embossing process forming an irregular lower edge 26 formed by compression and calendaring under pressure and heat. This results in an irregular line accurately resembling the lower or butt ends of wood shingles or shakes and the like. The outer or weather surface of the outer face 20 is formed by an embossing process followed by impregnation with stain, paint, "Wolmanizing" or other treatment of the wood to make it more resistant to weathering. Similarly, the panels 20 may be formed from hardboard, plastic, pressed wood fiberboard, molded urethane foam or the like.

Figure 2:
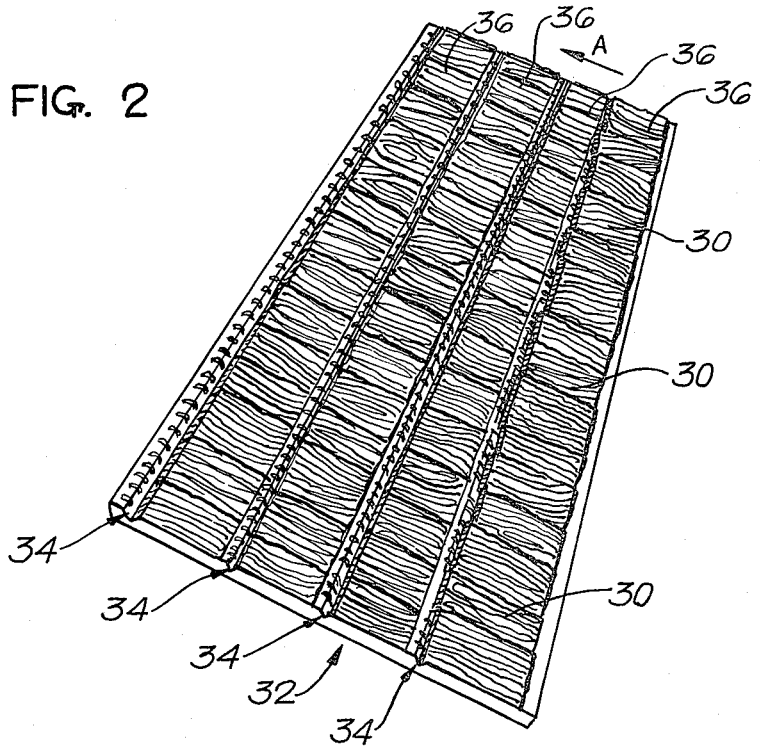
FIG. 2 is a perspective view of a sheet of building material which has been deep embossed to provide four rows of rectangular building panels each of which resembles a plurality of wood shake shingle elements laid side-by-side.

Referring to FIG. 2, a plurality of rows of simulated cedar shakes or tiles 30 are simultaneously embossed on one surface of a sheet 32 of a suitable building material, such as pressed wood fibers. Typically the sheets may be four feet by sixteen feet in length with the rows running along the sixteen foot length so that all the shingles or shakes 30 are facing in the same direction, as shown by arrow A in FIG. 2. A surface irregularity or discontinuity, generally designated 34, is provided between each row 36 comprising a plurality of the shingles 30.

Figure 3:
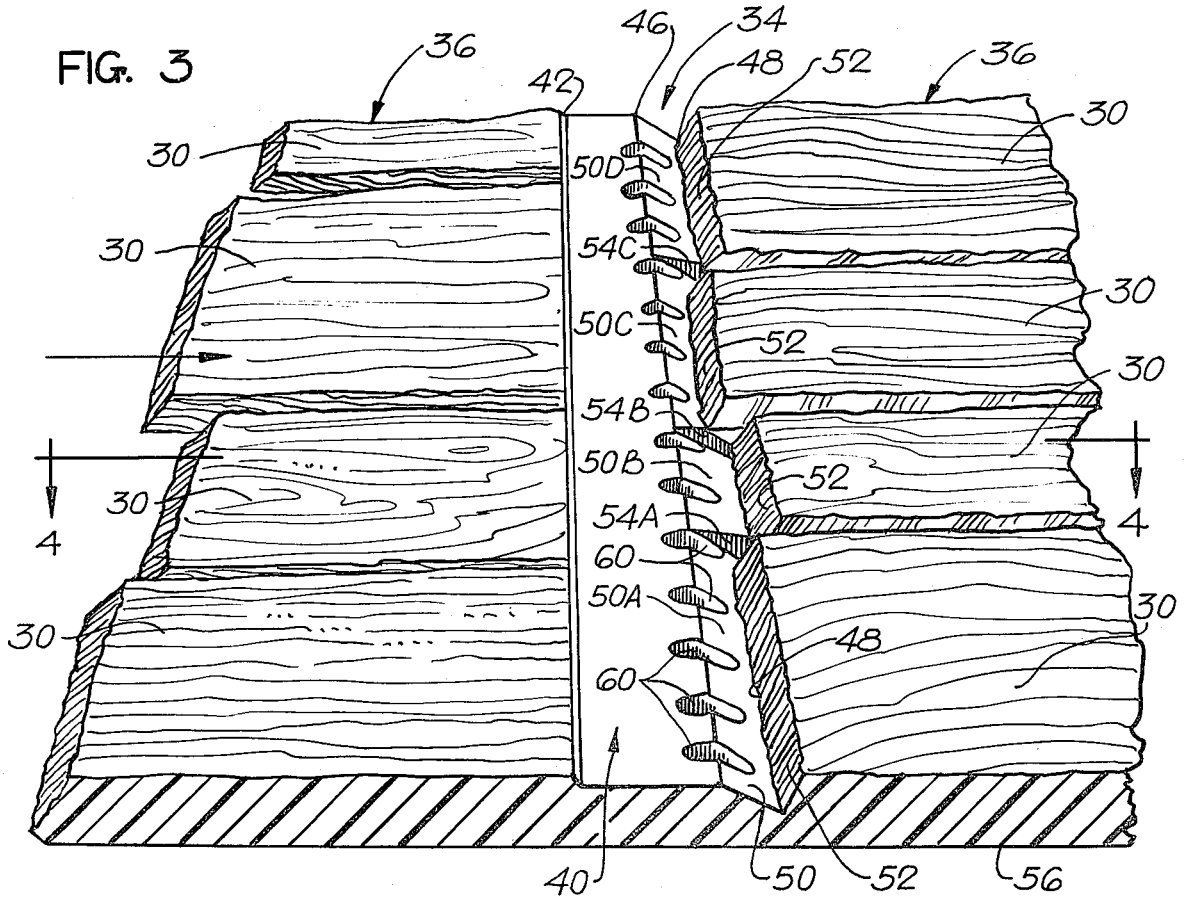
FIG. 3 is an enlarged, fragmentary perspective view of a portion of the panel shown in FIG. 2 illustrating the discontinuity formed between adjacent rows.
Figure 4:
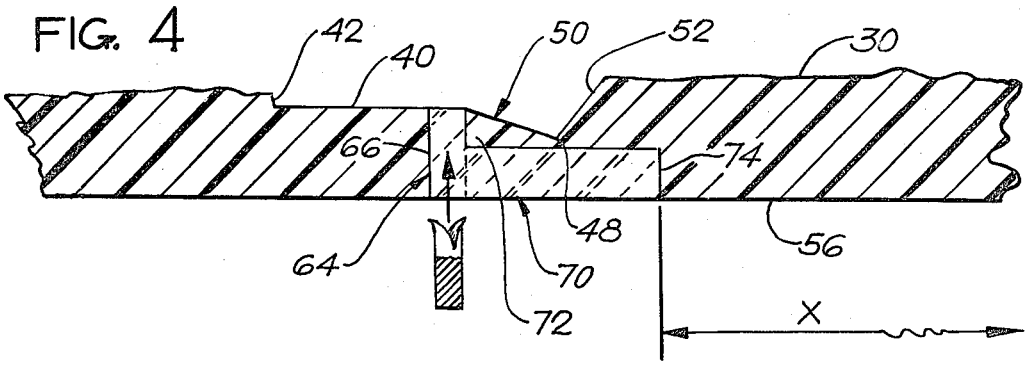
FIG. 4 is a vertical section taken generally along line 4—4 of FIG. 3 showing the preferred method of detaching adjacent building panels.

FIG. 3 illustrates a closeup generally perspective view of one of the discontinuities 34 between two adjacent rows 36. A cross section or vertical edge shown at the bottom of FIG. 3 illustrates the relative dimensions between the shingle portions 30 and the discontinuity 34. The discontinuity 34 as shown is formed in one deep embossing operation to provide the plurality of surfaces or elements shown in FIG. 3. In particular, the discontinuities 34 each include a relatively large flat surface or land area portion 40 adjacent the upper or top edge of the shakes 36 shown on the left in FIGS. 3 and 4. The land portion 40 is separated from the shake surfaces by a generally upstanding short wall portion 42. The wall 42 may be formed at right angles with the land 40 but preferably forms an obtuse angle therewith for drainage purposes as will be described in detail hereinafter. The wall 42 provides a flat or straight line or edge along the top surface of the row 36. The land portion 40 terminates at a ridge or line 46 at which point the discontinuity forms a valley or trough having a bottom low point or line 48. The valley line 48 is formed by the intersection of a generally planar sloping wall portion 50 on the lefthand side thereof and a steeper or more inclined bottom wall portion 52 at the bottom or lowermost edge of each one of the individual shakes 30. Note that the bottom wall 52 of each shake is also deep embossed with various reliefs of simulate the lower edge or grain of the individual shakes 30 which vary from shake to shake. The bottom wall 52 of the shakes 30 are exposed to the weather after installation of the building panels and the deep embossing of these edges reduces wicking when paints or other exterior coatings are applied to the wall as well as providing additional weather resistance to the edge.

The bottom walls 52 of each of the shakes 30 terminate at varying points to provide an irregular, realistic appearance. For this reason, the bottom edges of the walls 52 meet the opposing sloping wall 50 at various distances from the ridge 46 but always at the same depth relative to the planar surface 40. Therefore, the wall portion 50A has a greater slope than its next adjacent wall portion 50B while the wall portion 50C has even a greater slope than the wall portion 50A. This is particularly shown in FIG. 3 where each of the wall sections 50A through 50B meet the bottom points of the exposed edges 52 of the shingles 30 at the bottom point 48 in the valley. Because of the varying slopes between the wall portions 50A–50D, a triangular transition zone 54A, for example, is provided between the wall 50A and the wall 50B. Similarly, another triangular transition zone 54B is provided between the wall portion 50B and the wall portion 50C. Finally, another transition zone 54C is provided between the wall portions 50C and 50D. Each of these transition zones 54A–54C is provided in the same deep embossing process which forms the individual shakes 30. However, as pointed out above, the bottom line 48 between each wall portion 50 and shake edge 52 is at precisely the same depth relative to the planar surface 40 so that there is a constant dimension from the back wall 56 of each panel 32 and the respective valley line or point 48. In addition to the various angles described, a plurality of break grooves or notches 60 are provided at the ridge line 46 to facilitate separation of the adjacent rows 36 formed on one panel 32 as will be described in greater detail hereinafter.

After each of the rows 36 has been formed on a sheet 32, a subsequent operation separates the rows 36 into the individual rectangular building panels. The steps of this separating operation are shown more clearly in FIG. 4. In the preferred method of practicing the present invention, the thickness of the panel 36 is significantly reduced at a point adjacent to and extending in both directions from the bottommost point 48 in the valley to facilitate separation of adjacent rows distinctly at the lowermost edge of each one of the bottom sides 52 of the shingles 30. In one method, this is accomplished in a two-step cutting process. In the first step of the cutting process, a typical or conventional saw blade is passed along the ridge 46 as shown by the vertical cross-hatched section 64 in FIG. 4. This first cut provides a constant dimension between the wall 42 and the top edge 66 of each of the rows 36 so that the land area or surface 40 between the upper edge 66 and the wall 42 is the same for each one of the rows 36.

According to the preferred method, a second cut is made to reduce the thickness of the panel at the valley line 48. This second cut can be accomplished by the use of a router or batten cutter from the underside or backside 56 of the panel. Each of the rows 36 have been separated from one another during the first cut 64 providing the planar upper edge 66 which can therefore be used as a guide when making the second cut or thickness reduction operation. In particular, referring to FIG. 4, the second cut is represented by a generally horizontal cross-hatched section 70 which extends upwardly from the back surface 64 of the panel approximately to or slightly through the bottom valley line 48 thereby eliminating or separating the small triangular portions 72 formed by the wall 50. The notches 60 as described previously with respect to FIG. 3 facilitate the separation of this triangular portion 72 from the building panel portion 36. This batten cut is positioned to provide a constant dimension X between the right-hand edge 74 of the batten cut and the upper edge 66 of a particular panel 36. Since the valley line 48 of each of the shingles 30, regardless of their particular length is at the same depth, the batten cut will terminate each of the shingle bottom edges 52 in one pass or operation. The dimension between the upper edge 66 of each panel and the lower edge determined by the valley line 48 preferably ranges between 11.525 inches and 11.775 inches. Therefore, the dimension X, previously described, is maintained at a substantially lesser dimension than 11.5 inches. If the batten cut extends upwardly in FIG. 4 through the valley line 48 so as to separate two adjacent panels in one pass with the batten cutter, an alternate practice of the present invention could be made while eliminating the previously described first cutting operation 64. If this alternate method were used, however, the triangular portion 72 would remain as a unitary element connected to the subjacent row or panel 36.

The batten cut as previously described thus provides the plurality of building panels 36 each having an irregular bottom edge for the shingles 30 representing or accurately resembling a plurality of shingle elements laid side-by-side. Of course, if the building panel 32 is deformed from a flat configuration as shown in FIG. 2 to a curved configuration such as the Spanish tiles 10C, during the deep embossing process, obviously some modifications would be required in the cutting operation to provide for a consistent dimension across the lower edges of the generally curvilinear Spanish tile elements.

Figure 5:
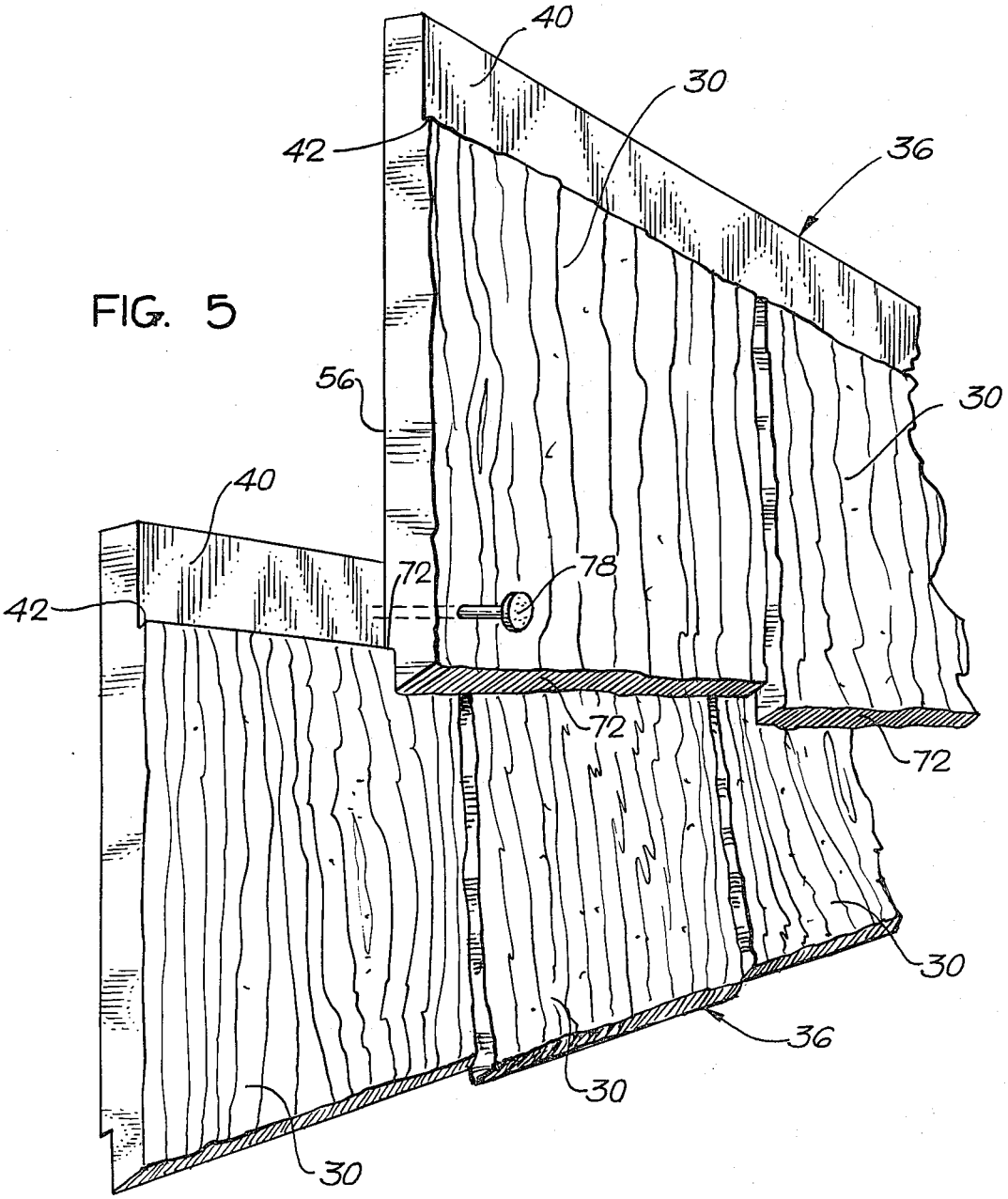
FIG. 5 is a perspective view illustrating the manner in which the panels are assembled for construction.

FIG. 5 shows a typical installation of the building panels of the present invention. In particular, the building panels are secured to the exterior wall or roof of a building starting at the lowermost point on the structure. The building panels 36 are overlapped as shown in FIG. 5 to provide a weather-tight seal. In particular, the bottom of the back surface 56 of the panel to be applied is set on the planar surface 40 of the subjacent panel with the cut surface 74 formed by the batten cut engaging the wall or surface 42 at the top of the shakes of the lower panel 36 and secured thereto by nails 78 or other suitable construction fasteners. In this manner, the tapered, finished edge 52 of each shingle 30 will overlap a portion of one or more shingles 30 of the lower building panel 36 so as to accurately resemble a plurality of shingles laid side-by-side. Of course, some of the shingles will incur a larger overlap because of their larger dimension but the present invention and method insures that there will be at least some significant overlap regardless of the length of the upper shingle 30.

The foregoing detailed description has been given for clearness of understanding only and no unnecessary limitations should be understood therefrom as some modifications will be obvious to those skilled in the art.

We claim:

1. A building panel having a back face, top, bottom and opposite side edges and an outer front face having a deep embossed, weather resistant surface formed with a pattern resembling a plurality of shingle elements laid side-by-side in a common row having an irregular lower edge, at least one severance discontinuity formed in said panel sheet positioned along said irregular edge on said row of shingle elements, said panel having a section of reduced thickness along said irregular edge formed in said back face adjacent to said severance discontinuity, said section of reduced thickness adapted for overlapping a top portion of a subjacent building panel upon application of the panels to the exterior of a building structure, said irregular lower edge extending between said outer front face and an intermediate surface between said back face and said front face defining said section of reduced thickness.

2. The building panel of claim 1 wherein an upper edge portion on said outer face of the panel is formed with a land area of reduced thickness for overlapping engagement with said intermediate surface on the back of an adjacent building panel in overlapping relation therewith.

3. The building panel of claim 2 wherein each of said simulated shingle elements includes a substantial portion thereof of reduced thickness, extending outwardly from a non-reduced thickness portion for overlapping an outer face on the simulated shingle elements on a next subjacent building panel.

4. A method of making a building panel from a sheet of material of larger dimension comprising the steps of:

deep embossing a portion of said sheet to form an outer front face of at least one of said panels with an embossed pattern resembling a plurality of shingle shapes of varying dimension laid in a side-by-side pattern in a row and having an irregular lower edge formed by said deep embossing process;

forming a plurality of severance discontinuities adjacent said irregular edge of said side-by-side pattern to facilitate separation of adjacent patterns; and reducing the thickness of said sheet at said discontinuity to separate said panel and said sheet along said irregular lower edge of at least one of said panels.

5. The method of claim 4 wherein said reduction step comprises the removal from a back face of said panel opposite said outer face a predetermined amount of material to provide a planar surface at and adjacent to said severance discontinuity to separate at least one of said panels from the remaining portion of said sheet along said irregular lower edge of said side-by-side pattern.

* * * * *